US005562576A

United States Patent [19]

Mangine

[11] Patent Number: 5,562,576

[45] Date of Patent: Oct. 8, 1996

[54] ROUND ROWING TANK

[76] Inventor: Joseph D. Mangine, 2156 Rte. 67, Galway, N.Y. 12074

[21] Appl. No.: 301,971

[22] Filed: Sep. 7, 1994

[51] Int. Cl.[6] ..... A63B 64/06

[52] U.S. Cl. ..... 482/72; 482/73

[58] Field of Search ..... 482/72, 73, 74; 434/247, 255; 472/13, 14; 440/101, 102, 113

[56] References Cited

U.S. PATENT DOCUMENTS 927,833 7/1909 Cunningham ..... 482/73

5,306,219 4/1994 Solymosi ..... 482/73

FOREIGN PATENT DOCUMENTS 2469187 5/1981 France ..... 482/72

0597799 3/1978 U.S.S.R. ..... 482/73

*Primary Examiner*—Jerome Donnelly

*Attorney, Agent, or Firm*—Heslin & Rothenberg, P.C.

[57] ABSTRACT

A rowing machine for training rowers consisting of a round water tank with an inner and an outer wall and centrally located rowing stations with seats, slides, foot stretchers, and oarlocks is disclosed. The rowing stations are radially disposed within the inner wall. As the number of rowing stations is increased or decreased, the radius of the tank may be correspondingly increased or decreased.

7 Claims, 4 Drawing Sheets

ROUND ROWING TANK

FIELD OF THE INVENTION

The invention relates to a rowers' training apparatus which simulates the actual water resistance encountered by a rower as if rowing in a boat on a body of water.

BACKGROUND

There has long been an interest in providing a training apparatus for rowers that most accurately reproduces the feel of rowing racing shells on the water. The search up to now has produced a variety of different designs, each suffering from certain drawbacks.

J. H. Cunningham (U.S. Pat. No. 927,833) disclosed the use of two water tanks made of concrete. A tank of similar design is presently in use at Syracuse University. Because of the convoluted channels the water must travel through, this type of tank is equipped with motors to accelerate the water. Even with motors to speed up the water, the oars used in this tank must have holes gouged in them so a racing cadence can be obtained. Because the water is forced to make an abrupt turn at the ends of the tank, thick concrete must be used to withstand the force of the water. To shape a concrete tank with rounded ends special forms must be built. Costly motors must be installed and maintained. Few rowing programs can afford such rowing tanks.

A second type of tank known in the art is shown in FIG. 4. In this type of rowing tank there is one channel in which the water circulates. The tank has four corners and is covered by a deck that bridges the four corners. Diversion plates are suspended from the decking to help divert the water from slamming into the flat walls at the corners. Once again, the walls of such a tank must be very strong to resist the force of the water slamming into the corners. An additional consequence of the water moving slowly, due to the tank's corners and end channels, is that some of the blade must be cut off a standard racing oar in order to use it in this type of tank. Cutting down the oar allows it to slip in the water, thereby permitting a stroke rate which is slightly higher than would be possible with conventional oars but which is far short of racing cadence. Simmons College in Boston, Mass. has a tank of this design.

Another type of rowing tank is described in U.S. Pat. No. 5,306,219, to Solymosi. The Solymosi tank is designed for sculling, in which a single oarsman pulls two oars, rather than for sweep rowing, in which each rower pulls one oar. The present invention is an apparatus for sweep rowing. Because of the very sharp, unassisted turns in the Solymosi tank, the water will slow down markedly at the ends as well as at the sides of the tank where the oars are not pushing it.

SUMMARY OF THE INVENTION

The shortcomings of the tanks of the art are overcome and additional advantages are provided by the instant invention, which, in one aspect, relates to a circular rowing tank comprising: (a) an outer wall in the form of a circle having a center point and a radius; (b) an inner wall in the form of a circle having a common center point with the outer wall and a smaller radius than the outer wall; (c) a bottom disposed between the inner and outer walls; (d) the outer wall, inner wall and bottom forming in combination a water-tight canal in the form of a ring; and (e) a plurality of rowing stations radially disposed between the inner wall and the center point.

Commonly each of the rowing stations comprises a seat, a foot stretcher and an oarlock. In preferred embodiments, there may be from 5 to 8 stations. When there are 5 stations, they are in the form of a regular pentagon having a common center with the inner and outer walls. When there are 6 stations, they are in the form of a regular hexagon having a common center with the inner and outer walls. When there are 7 stations (not shown), they are in the form of a regular heptagon having a common center with the inner and outer walls. When there are 8 stations, they are in the form of a regular octagon having a common center with the inner and outer walls.

In another aspect the invention relates to a method for simulating the effect of rowing a boat comprising: (a) providing a pool of water having a substantially circular perimeter and a plurality of rowing stations radially disposed within the perimeter; (b) providing a plurality of oars, having blades and shafts, said oars pivotally attached to the rowing stations along radii; and (c) drawing the oar blades through the water in such manner as to create a circular flow in the pool, whereby the circular flow is maintained solely by drawing the oar blades through the water.

Accordingly, several advantages are associated with the round rowing tank of the invention. A round tank has no baffles or corners to slow the water, so the water can be accelerated all the way through 360 degrees. Consequently the water is accelerated or maintained in a close relationship to the effort that is being applied to the oars. The water in a round tank responds more closely to the effort of the rowers because there are no runs where the water is not being pushed. Because the water moves fast, it does not resist the advance of the oar. This permits the use of full size oars, so that rowers may train with the same oars they race with. Even the new hatchet blades row well in the tank of the invention. Moreover, the full-sized oars can be used to obtain a racing cadence.

Because the round tank has no corners or ends, the walls do not have to be built strong enough to resist water slamming into walls and ends, so a big savings can be made in construction cost.

BRIEF DESCRIPTION OF THE DRAWINGS

These and other objects, advantages and features of the present invention will be more readily understood from the following detailed description of preferred embodiments thereof, when considered in conjunction with the accompanying drawings in which.

DESCRIPTION OF THE PREFERRED EMBODIMENTS

Reference is now made to the drawings in which the same reference numbers are used throughout the different figures to designate the same or similar components.

In order to have a round tank it is necessary for all rowers to row either port or starboard so that the water will circulate either clockwise or counterclockwise. In all other rowing tanks the rowers sit in line one behind the other. In the present tank they sit on an angle to one another.

Figure 1:
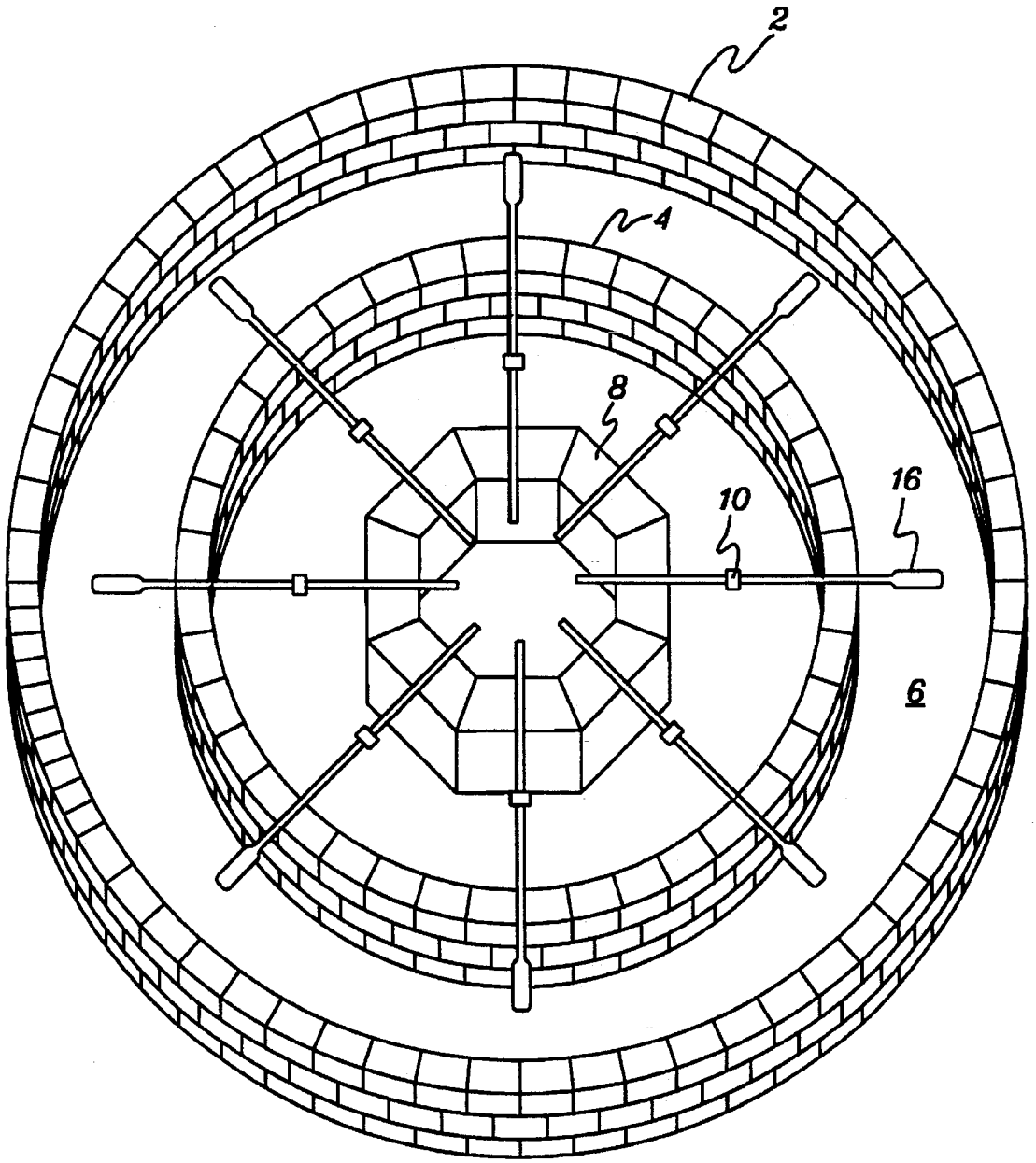
FIG. 1 is a perspective view from above of a rowing tank for eight persons according to the invention.

FIG. 1 shows a tank for eight rowers from above. The tank comprises an outer wall 2, an inner wall 4, a bottom 6, and eight rowing stations 8, each associated with an oarlock 10, located on a radius of the circle formed by the outer and inner walls. An oar 16 is positioned in the oarlock.

Figure 2:
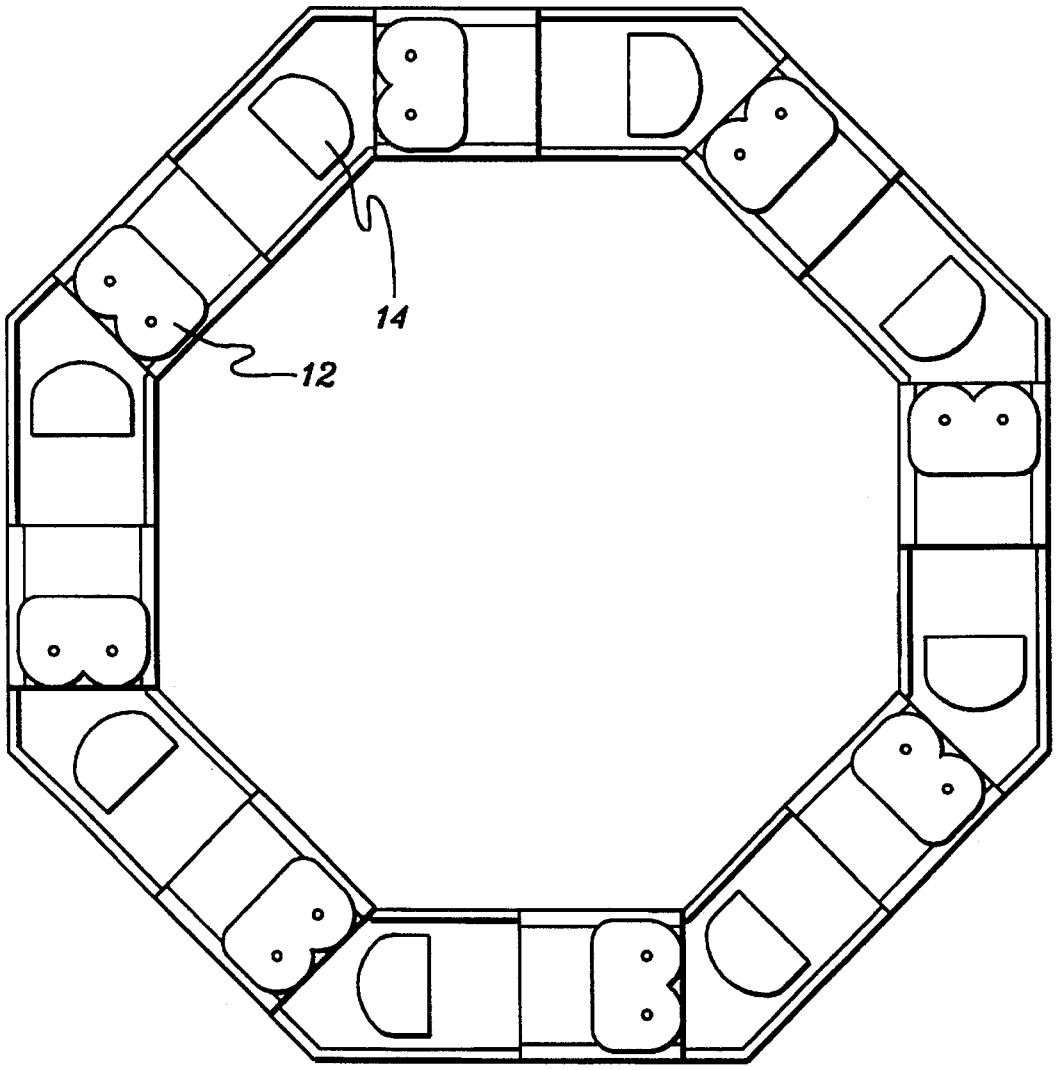
FIG. 2 is a schematic view from above of a rowing station arrangement for eight persons according to the invention.

FIG. 2 shows a set of eight rowing stations 8, as above, in greater detail. Each station comprises a seat 12, mounted as known in the art on a slide (not shown), and a foot stretcher 14. The stations are linked together to form a regular octagon.

Figure 3:
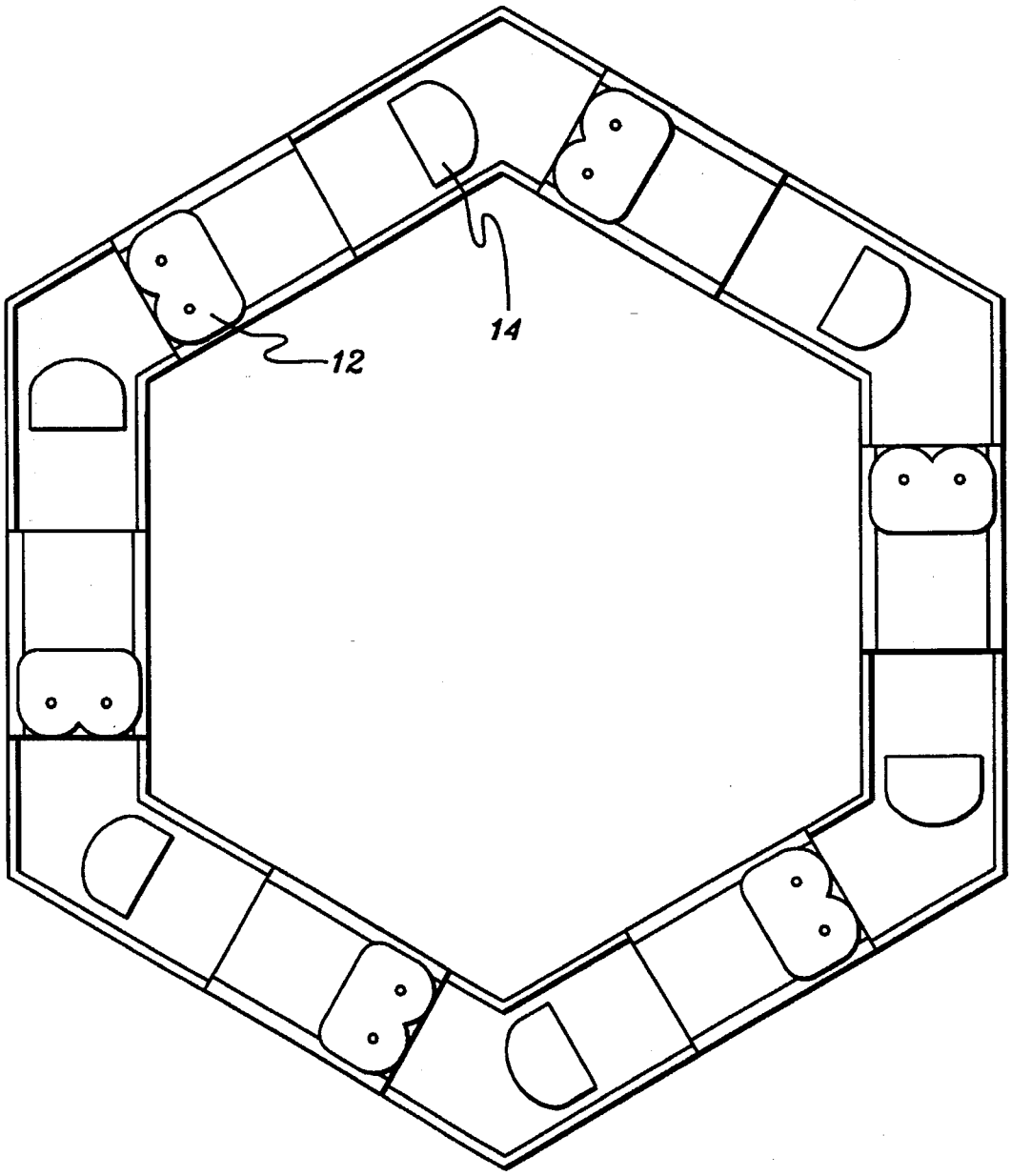
FIG. 3 is a schematic view from above of a rowing station arrangement for six persons according to the invention.

FIG. 3 shows a set of six rowing stations 8, as above, in greater detail. As before, each station comprises a seat 12, mounted as known in the art on a slide (not shown), and a foot stretcher 14. The stations are linked together, in this case, to form a regular hexagon.

Figure 4:
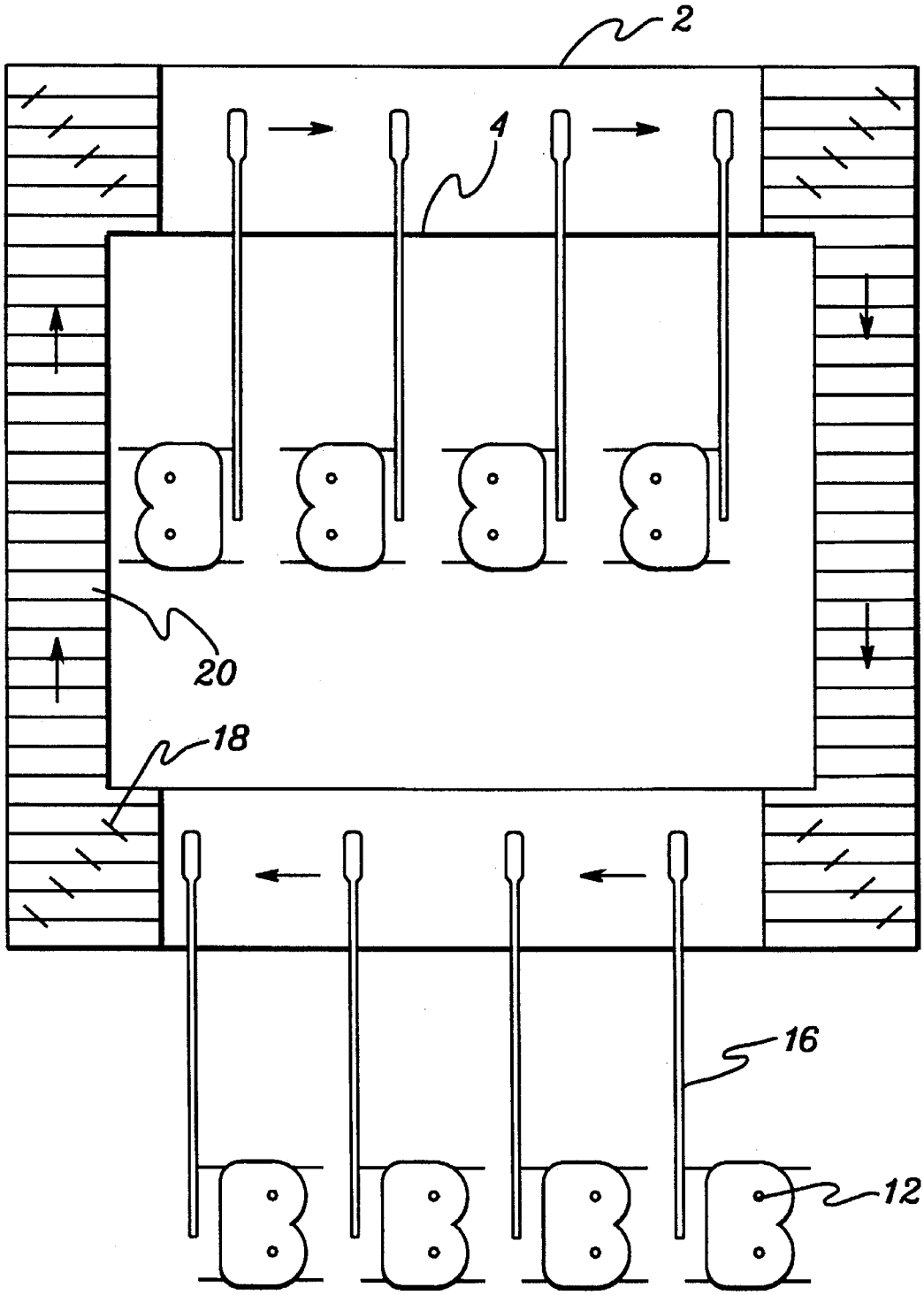
fig. 4 PRIOR ART
FIG. 4 is a schematic view from above of a rowing tank according to the art.

FIG. 4 shows a tank according to the art. The tank comprises an outer wall 2, an inner wall 4, a bottom 6, and eight rowing stations, each associated with a footstretcher (not shown), a seat 12 and an oar 16. Of particular note are the diversion plates 18 suspended from decking 20 at each corner. These are required to direct the flow of the water as explained above.

The tank of the invention may be constructed using readily obtainable building materials, concrete block being the least expensive at this time. Using concrete block, the tank can be built at a fraction of the cost of previous rowing tanks, achieving savings in both building material cost and labor costs to construct.

I built a tank as depicted in FIG. 1 in Menands, N.Y. To build my tank I first scratched two circles on a concrete floor. Then I placed concrete block on the circles providing me with two round walls. Because the installation was not to be permanent, I used no steel in the core of the walls; instead I put steel cable around the convex side of the walls.

The center of the rowing tank where rowers sit was made of wood. Each rower was provided with a section to row in.

If the tank is designed for eight rowers, then they sit in an octagon configuration. If the tank is designed for five rowers, they sit in a pentagon configuration. A tank built for five rowers can be built in a smaller area than one built for eight rowers. A round tank can be built for any amount of rowers. Five people can row in a tank designed for more than five but without optimum results. The seats, slides, oars and oarlocks are the same as used in racing shells. They can be scavenged from old boats or purchased from suppliers of rowing equipment.

I claim:

1. A circular rowing tank comprising:

(a) an outer wall in the form of a circle having a center point and a radius;

(b) an inner wall in the form of a circle having a common center point with said outer wall and a smaller radius than said outer wall;

(c) a bottom disposed between said inner and outer walls;

(d) said outer wall, inner wall and bottom forming in combination a water-tight canal in the form of a ring; and (e) a plurality of at least five fixed rowing stations radially disposed between said inner wall and said center point in the form of a regular polygon having a common center point with said walls.

2. A rowing tank according to claim 1 wherein each of said rowing stations comprises a seat, a foot stretcher and an oarlock.

3. A rowing tank according to claim 1 wherein said plurality of rowing stations consists of from 5 to 8 stations.

4. A rowing tank according to claim 3 wherein said plurality of rowing stations consists of 5 stations in the form of a regular pentagon having a common center with said inner and outer walls.

5. A rowing tank according to claim 3 wherein said plurality of rowing stations consists of 6 stations in the form of a regular hexagon having a common center with said inner and outer walls.

6. A rowing tank according to claim 3 wherein said plurality of rowing stations consists of 8 stations in the form of a regular octagon having a common center with said inner and outer walls.

7. A method for simulating the effect of rowing a boat comprising:

(a) providing a circular rowing pool, partially filled with water comprising:

(i) an outer wall in the form of a circle having a center point and a radius;

(ii) an inner wall in the form of a circle having a common center point with said outer wall and a smaller radius than said outer wall;

(iii) a bottom disposed between said inner and outer walls;

(iv) said outer wall, inner wall and bottom forming in combination a water-tight canal in the form of a ring; and (v) at least five fixed rowing stations radially disposed between said inner wall and said center point in the form of a regular polygon having a common center point with said walls;

(b) providing a plurality of oars, having blades and shafts, said oars pivotally attached to said rowing stations along radii of said circles and (c) drawing said oar blades through said water in such manner as to create a circular flow in said pool, whereby said circular flow in said pool is maintained solely by drawing said oar blades through said water.

* * * * *